United States Patent [19]

Hardy

[11] Patent Number: 5,071,070

[45] Date of Patent: Dec. 10, 1991

[54] APPARATUS FOR DISPENSING FLUID INTO THE WATER FLOW OF A SHOWER

[76] Inventor: Duard I. Hardy, 14105 Knottingsley Pl., Tampa, Fla. 33624

[21] Appl. No.: 410,353

[22] Filed: Sep. 21, 1989

[51] Int. Cl.[5] ..... B05B 7/30

[52] U.S. Cl. ..... 239/311; 222/132; 222/144.5; 239/303; 239/318

[58] Field of Search ..... 222/325, 145, 129, 185, 222/637, 630, 1, 129.2, 132, 133, 144.5; 239/304, 305, 307, 310, 318, 10, 260, 414, 303, 311; 251/267; 137/801

[56] References Cited

U.S. PATENT DOCUMENTS

| | | | |
|---|---|---|---|
| 2,606,068 | 8/1952 | Bonacor | 239/310 |
| 2,716,507 | 8/1955 | Graves | 239/318 |
| 3,207,445 | 9/1965 | Court et al. | 239/318 |
| 3,419,246 | 12/1968 | Burgess | 251/263 |
| 3,720,352 | 3/1973 | Kozlowski | 239/310 |
| 3,764,074 | 10/1973 | James | 239/318 |
| 3,797,747 | 3/1974 | Buzzi et al. | 239/318 X |
| 3,825,187 | 7/1974 | Tatge | 239/318 |
| 3,917,172 | 11/1975 | O'Hare | 222/132 X |
| 4,218,013 | 8/1980 | Davison | 239/305 X |
| 4,358,056 | 11/1982 | Greenhut et al. | 239/305 |
| 4,432,105 | 2/1984 | Pitroda | 222/144.5 X |
| 4,454,891 | 6/1984 | Dreibelbis et al. | 137/801 |
| 4,607,793 | 8/1986 | Eberle | 239/318 |
| 4,623,095 | 11/1986 | Pronk | 239/318 X |
| 4,651,930 | 3/1987 | Magaha, Jr. | 222/133 X |
| 4,807,783 | 2/1989 | van Zijverden | 239/318 X |
| 4,840,311 | 6/1989 | Shamblin | 239/305 |

*Primary Examiner*—Kevin P. Shaver
*Attorney, Agent, or Firm*—Dominik, Stein

[57] ABSTRACT

An apparatus to selectively introduce a fluid from one of a plurality of containers into a stream of water flowing through a shower head. The apparatus comprises a housing, a main water passageway therethrough, a plurality of bottles containing fluid to be fed therefrom, supplemental passageways coupling the bottles and the main water passageway whereby fluid from the container may flow to the main passageway by venturi forces created by flowing water, a valve mechanism means movable between open and closed positions by the venturi forces to allow or preclude the feeding of fluid to the flow of water, and user controlled means to selectively allow the valve mechanism to be coupled with the venturi force. Also disclosed is the method for selectively introducing a fluid from a container into a stream of water flowing through a shower head by venturi forces of the flowing water.

7 Claims, 4 Drawing Sheets

APPARATUS FOR DISPENSING FLUID INTO THE WATER FLOW OF A SHOWER

FIELD OF THE INVENTION

This invention relates to a method and apparatus for dispensing fluid into the water flow of a shower and, more particularly, to the selective introduction of one of a plurality of fluids into the water flow of a shower while emulsifying such dispensed fluid.

DESCRIPTION OF THE BACKGROUND ART

For many years, showers have been an integral part of one's personal cleanliness and hygiene. When taking a shower, a flow of water pours over the person's body. Periodically the person may disperse soap, shampoo or other fluid over his or her body while in the stream of water. Thereafter, the fluid is rinsed. The water may readily be controlled for volume and temperature.

In recent years, showers have become a source of relaxation and grooming. This is in large part due to technical advances which allow for the mixing of soap, shampoo or other fluids into the flow of water under the control of the user. This eases the showering process. Further, a wide variety of other fluids, such as soothing lotions and fragrant oils, may be so mixed with the water which adds to the enjoyment of the shower as well as the grooming of the person's body. In addition, efforts have been made to readily couple such fluid-dispensing devices with the shower head for convenience of installation and use along with attractiveness of the device itself to render the bathroom more aesthetically appealing.

The patent literature documents the dissatisfaction of many people with known fluid-dispensing devices for shower heads. Consider, for example, patents directed to gravity feeding a single fluid into a shower head as exemplified by U.S. Pat. No. 3,612,404 to Vicari; U.S. Pat. No. 3,907,203 to Skillings; U.S. Pat. No. 4,047,541 to Mercier; and U.S. Pat. No. 4,189,100 to Karp; U.S. Pat. No. 4,293,083 to Meares and U.S. Pat. No. 4,623,095 to Pronk. Gravity feeding fluids to a shower head from one of a plurality of sources is disclosed in U.S. Pat. No. 3,720,352 to Kozlowski; U.S. Pat. No. 4,019,658 to Consaui; U.S. Pat. No. 4,200,206 to Chase and U.S. Pat. No. 4,208,266 to Queen.

Dispensing liquids to water of a shower head from a container beneath the shower head is disclosed is U.S. Pat. No. 3,207,445 to Court; U.S. Pat. No. 3,231,200 to Held and U.S. Pat. No. 3,539,111 to Johnson. Selectively dispensing fluids from one of a plurality of containers beneath the shower head is disclosed in U.S. Pat. No. 4,218,013 to Davison. Additionally, dispensing a first fluid into a second fluid flow in a non-shower application is disclosed in U.S. Pat. No. 2,928,576 to Kochner.

Lastly, German Pat, No. 28 17 043 to Mohn of 4/19/78 discloses shower dispensers of an elongated design. The flow of water is around the container while an operator controlled valve allows opening of the container so that its contents may be dispensed.

As illustrated by the great number of prior patents and commercial devices, efforts are continuously being made in an attempt to add fluids to the stream of shower water more efficiently, conveniently, reliably and economically. None of these previous efforts, however, provides the benefits attendant with the present invention. Additionally, prior techniques and apparatus do not suggest the present inventive method steps and combination of component elements arranged and configured as disclosed herein.

The present invention achieves its intended purposes, objects and advantages over the prior art through a new, useful and unobvious combination of component elements, with the use of a minimum number of functioning parts, at a modest cost to manufacture and by employing only readily available materials. Additionally, the present invention constitutes an excellent skin management system which reduces the stripping of beneficial body oils while reducing water usage to three gallons per minute and precluding the backdraw flow of fluids into the community water system in the event of a system malfunction.

It is, therefore, an object of this invention to provide a method and apparatus to selectively introduce a fluid from a container into a stream of water flowing through a shower head. The apparatus comprises a housing having a nipple to which a shower head may be attached, a socket for receiving the nipple of a water supply pipe and a main water passageway therebetween. Support means are formed in the housing for a bottle containing a fluid to be fed therefrom. A supplemental passageway in the housing couples the support means and the main water passageway whereby fluid from the container may flow to the main water passageway by the venturi force created by the water flowing through the main passageway. Air hole means may be formed in the housing for the drawing of fluid-emulsifying ambient air into the flow of fluid in the supplemental passageway by venturi forces. Valve means are moveable between open and closed positions by the venturi forces to allow or preclude the feeding of fluid to the flow of water. User controlled means selectively allow the valve means to be coupled with the venturi forces.

It is also an object of the invention to selectively dispense fluids into a flow of shower water.

It is a further object of the invention to use venturi forces to effect a flow of fluid into a stream of shower water.

Lastly, it is an object of the invention to emulsify fluids being delivered to a user through a flow of shower water.

The foregoing has outlined some of the more pertinent objects of the invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purpose of summarizing the invention, the invention may be incorporated into apparatus to feed a fluid from a bottle into a stream of water flowing through a shower head. The apparatus comprises a housing having a nipple to which a shower head may be attached, a socket for receiving the nipple of a water supply pipe and a main water passageway therebetween; support means in the housing for receiving a bottle containing the fluid to be fed therefrom; a supplemental passageway in the housing coupling the support means and the main passageway whereby fluid from the bottle may flow to the main passageway by venturi forces created by the water flowing through the main passageway; valve means moveable between opened and closed positions and operable by the venturi forces to preclude the flow of fluid into the supplemental passageways and main passageway unless water is flowing through the main passageway; sealing means moveable between open and closed positions to allow or preclude the establishment of the venturi forces adjacent to the valve means; and user controlled means for selectively moving the sealing means between the open and closed positions.

The valve means includes a ball spring biased against an aperture through which fluid passes as it is fed from the bottle. The sealing means is a piston and the housing includes a chamber in which the piston is slidably supported and a spring is located within the chamber biasing the piston to the closed position. The valve means and sealing means are both resiliently urged to their closed positions and the venturi forces are sufficient to open the valve means but not the sealing means. The user controlled means is a handle pivotably connected to the piston and the handle includes a cam surface whereby movement of the handle downwardly and pivotally causes the cam surface to contact the housing for the continuous flow of fluid from the bottle. The bottle is formed of separable neck and base portions to facilitate refilling. Further included is air hole means in the housing for the drawing of fluid-emulsifying ambient air into the flow of fluid in the supplemental passageway by venturi action. The air hole means includes a plurality of holes adapted to draw ambient air into the fluid flow at a plurality of locations. The valve means is such as to open under venturi forces created by the flow of shower water, but is such as to remain closed under venturi forces tending to create a backflow of fluids during a malfunction of a community water system.

The invention may also be incorporated into a system for selectively dispensing one of a plurality of liquids into a stream of water flowing through a shower head. The system comprises a manifold having a nipple for coupling with a shower head, a socket for receiving the nipple of a water supply pipe and a main water passageway between the housing nipple and the socket; a plurality of container support means in the housing for threadably receiving and supporting a plurality of containers of liquid to be feed therefrom; a liquid passageway connecting each container support means and the main water passageway whereby liquid from any of the containers may be selectively dispensed to the main water passageway by venturi forces induced by the shower water flowing through the main water passageway; control means operable by a user for each of the liquid passageways moveable between a first position to close the liquid passageway and prevent the dispensing of liquid from its associated container and second position to open the liquid passageway and allow the dispensing of liquid from its associated container; and a restricted orifice coupling the main water passageway and the liquid passageways to increase the venturi forces.

The manifold formed of plural components bonded into a one piece device and further includes valve means associated with each container support means to preclude the flow of fluid into the supplemental passageways unless the operator controlled means is open and water is flowing through the main passageway. The operator controlled means is a piston and further includes resilient means associated with each of the pistons biasing its piston to the first position. A seal surrounds the end of each piston spaced from the liquid passageway whereby liquid is prevented from leaking therepast. Each of the operator controlled means includes a handle having a cam whereby movement of the handle downwardly and pivotally causes the cam to contact an adjacent portion of the manifold to effect a continuous flow of fluid. Each of the containers is a refillable bottle with separable neck and base portions with an air hole in the base portion. Each valve means includes a stopper positioned in a container with a ball spring biased against an aperture. The system further includes a plurality of air holes for simultaneously introducing a plurality of flows of emulsifying air into the flow of liquid through each liquid passageway.

The invention may further be incorporated into a method for selectively introducing additive liquid from a bottle into a stream of water flowing through a shower head, comprising the steps of: (1) providing a manifold having a nipple to which a shower head may be attached, a socket for receiving a nipple of a water supply pipe and a main water passageway extending therebetween; (2) establishing a flow of water through the main water passageway; (3) supporting, in operative association with the manifold, a bottle with fluid for being fed along a fluid passageway to the flow of water by venturi force created by the flow of water; and (4) sealing the bottle with a valve, the valve adapted to allow the flow of fluid from the bottle upon the flow of water through the main passageway but adapted to preclude the flow of fluid from the bottle in the absence of a flow of water through the main water passageway. The method further includes the step of providing an air flow from exterior of the manifold to the fluid flowing from the bottle to the flow of water. The manifold is formed with a plurality of fluid passageways, one for each of a plurality of supported bottles. The method further includes the step of selectively effecting the flow of fluid from one of the bottles to the preclusion of the other bottles. The method further includes the step of maintaining the fluid passageway normally closed to preclude the venturi forces from opening the valve and selectively opening the fluid passageway to allow the venturi forces to open the valve.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific embodiment may be readily utilized as a basis for modifying or designing other methods and constructions for carrying out the same purposes of the present invention. It should also be realized by those skilled in the art that such equivalent methods and constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in conjunction with the accompanying drawings in which.

Similar reference characters refer to similar parts throughout the several Figures.

DETAILED DESCRIPTION OF THE PREFERRED EMBODIMENT

Figure 1:
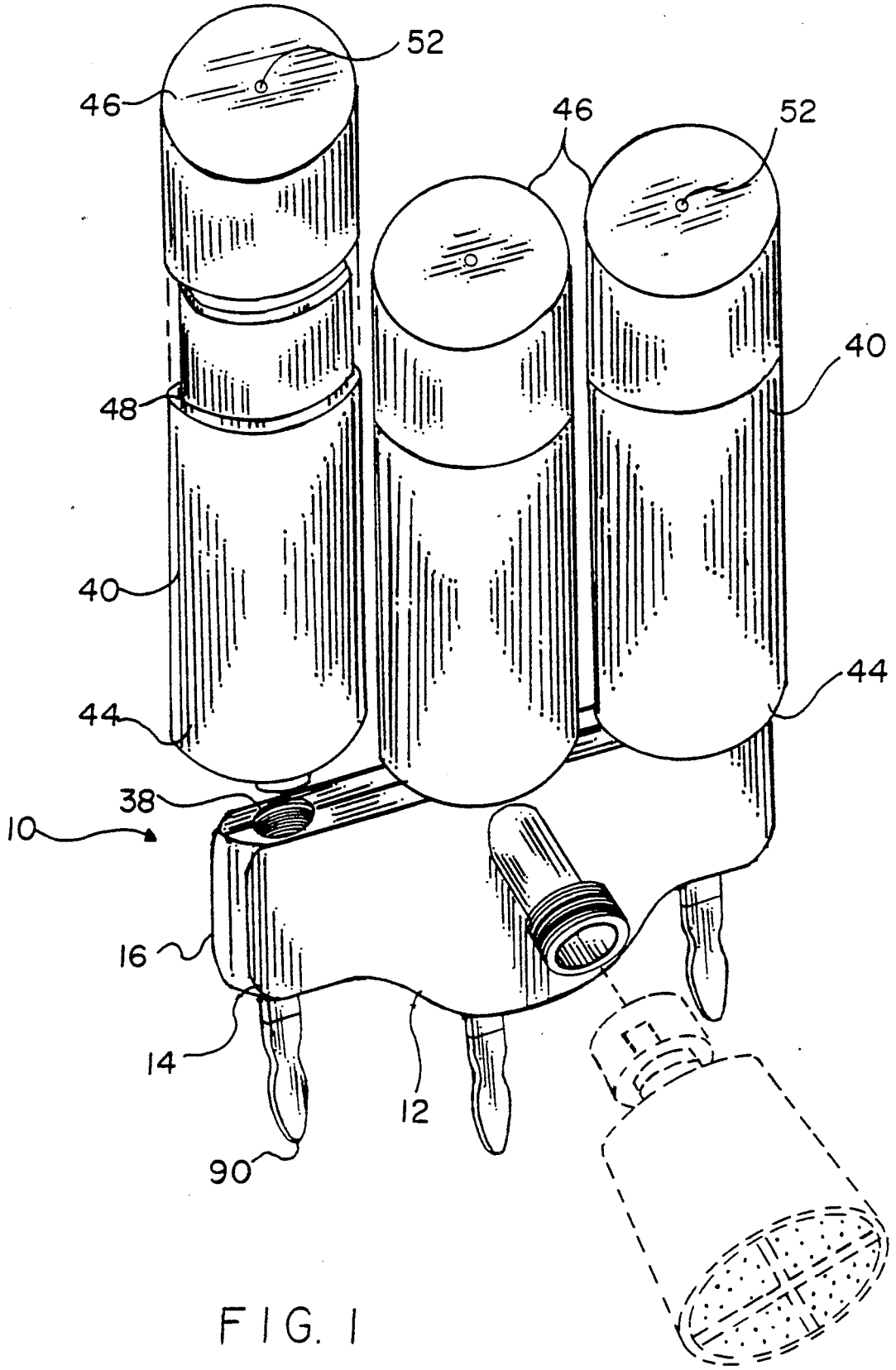
FIG. 1 is a perspective illustration of the apparatus constructed in accordance with the principles of the present invention adapted for coupling with a shower.
Figure 2:
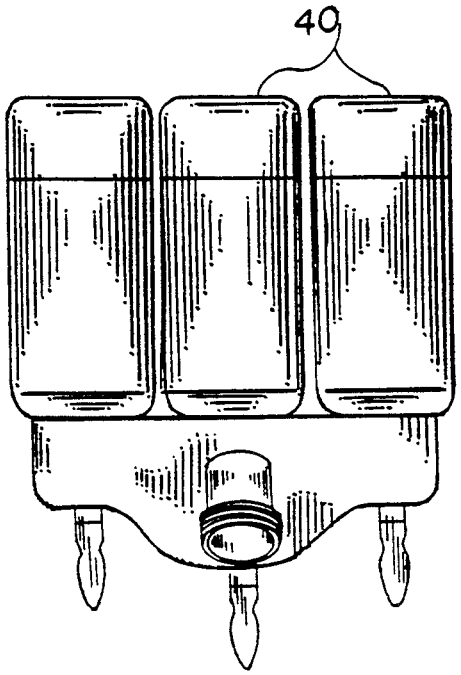
FIGS. 2 through 5 are front, rear, top, and side elevational views of the apparatus shown in FIG. 1.
Figure 3:
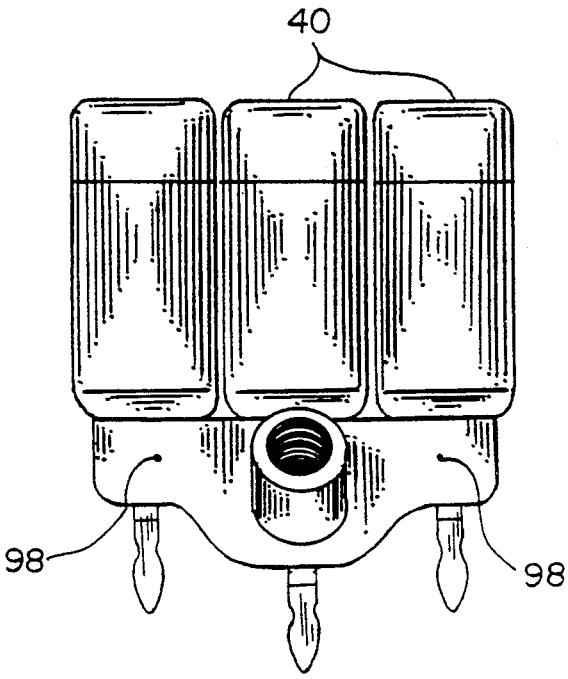
Figure 4:
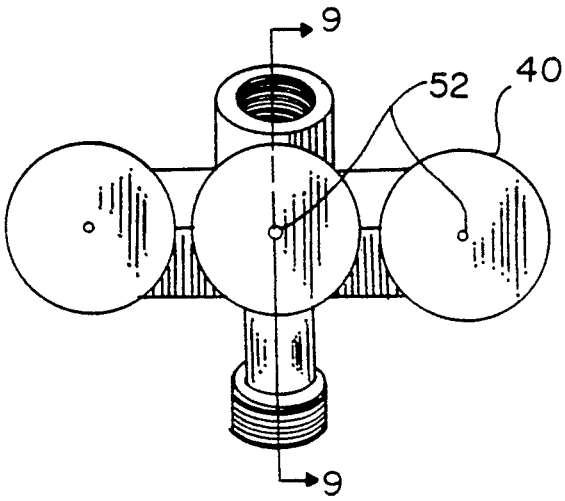

Shown in the various Figures is the fluid-dispensing apparatus 10 constructed in accordance with the principles of the present invention. The apparatus is, in effect, a housing or manifold 12 with supplemental elements, which, together, are adapted for dispensing liquids or other fluids into a flow of shower water. The manifold and other elements of the apparatus are fabricated of an injection-molded high-impact plastic, preferably ABS. The manifold is composed of two mating halves, a front half 14 and a rear half 16 which, when bonded by an adhesive or otherwise coupled together, create the unitive manifold 12. The mating of halves is done for ease of fabrication and provide a plurality of passageways 20, 22, 24 and 26 extending therethrough.

The input end of the manifold includes a threaded socket 30 adapted to threadably receive, and couple with, the threaded nipple of a conventional water supply pipe of a shower. The threaded socket is upwardly oriented at an angle with respect to the vertically extending parting line of the halves. On the opposite or output end of the manifold is a threaded nipple 32 onto which the shower head may be threaded. The axes of the socket and nipple are parallel but offset from each other. The previous angular orientation of water supply pipe and shower head, prior to installation of the apparatus 10, thus remains in essentially the same orientation. Negligible additional length is added by coupling the device between the shower head and the water supply pipe.

Figure 9:
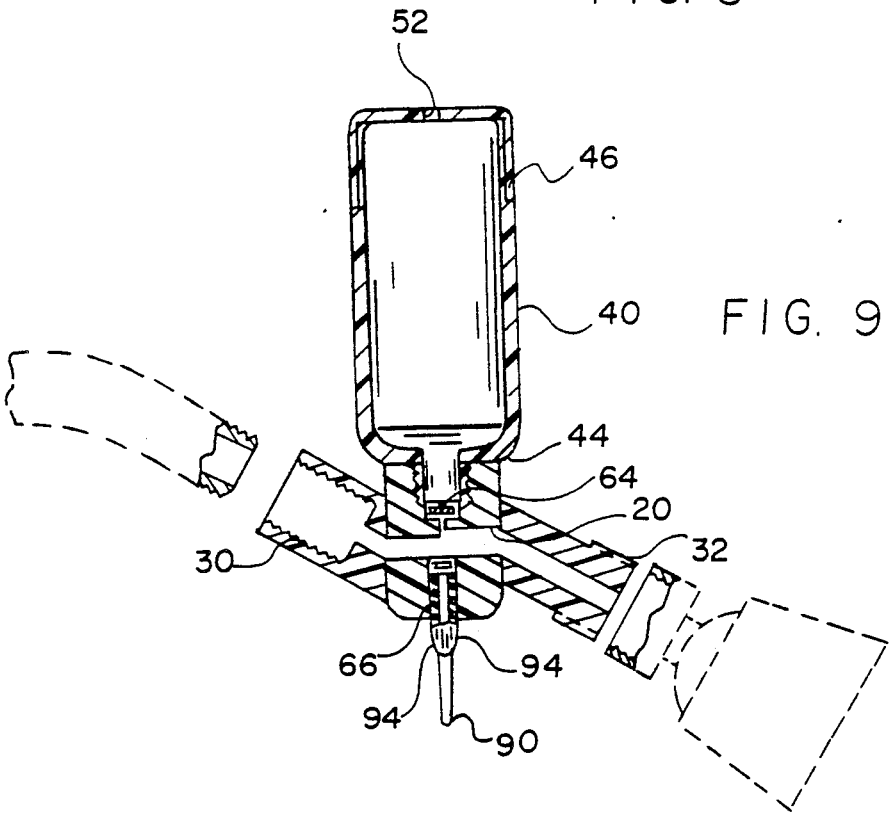
FIG. 9 is a sectional view taken along line 9—9 of FIG. 4.

Located within the manifold between the water inlet and the water outlet ends is a main passageway 20 for the flow of water from the pipe to the shower head and then the user. The main water passageway includes a narrow portion followed by an enlarged portion. Note FIG. 9. As water passes from the narrow portion to the enlarged portion, the velocity will increase and the pressure of the water will decrease.

Also formed within the manifold are a plurality of bottle receiving openings 38 with internal threads for removably receiving containers formed as bottles 40. The bottles are adapted to receive and contain the fluids to be dispensed into the flow of shower water. In the preferred embodiment, three such threaded openings are provided for receiving and supporting three bottles. Each bottle is circular in cross sectional and adapted to provide a separate and distinctive additive fluid, such as soap, shampoo, conditioner, lotion, oil, or the like, selected to the user's preference.

Figure 10:
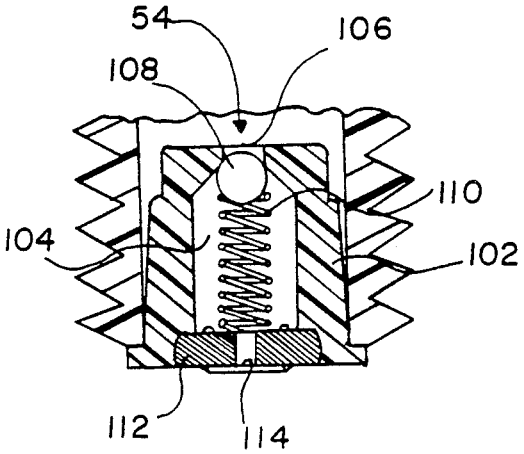
FIG. 10 is an enlarged sectional view of the mouth of one of the bottles including the valve.

Each bottle is provided with an open neck end 44 with threads for matingly engaging the threads in a manifold opening. Opposite from the neck end is a base end 46. Ends 44 and 46 couple to form the bottle. Ball check valve 108, as will be described hereinafter, seals the opening of each bottle adjacent its threads. A valve 108 is employed in each bottle even though it is only illustrated in FIG. 10. The base end 46 of the bottle is adapted to slidably mate in a recessed portion against a circumferential shoulder 48. The base end closes the bottle and may be removed for adding fluids to the bottle.

Centrally located on the base is a small hole or aperture 52 whereby air may enter the bottle upon the dispensing of the fluid therefrom. The small hole adds the further capability of generating a whistle during operation and use in the event that the bottle become emptied of its contents. This constitutes a gentle reminder to the user to refill the particular empty bottle.

Also located within the manifold are a series of supplemental smaller passageways 22, 24 and 26 by which fluid from one or more of the bottles may be fed into the larger main water passageway 20 for introduction into the flow of shower water. Like the main water passageway, the smaller supplemental liquid passageways are formed by the mating of recesses molded into the halves of the manifold. The central supplemental liquid passageway 24 is located for dispensing fluids vertically from the central bottle to the main passageway. In addition, a pair of side passageways 22 and 26 extend from the end-most bottles, first vertically then horizontally, and then vertically where they join with the central supplemental passageway. Thereafter, the supplemental passageways couple for delivering fluid along a common passageway or mixing zone 54 into the main passageway for mixing with the shower water. These supplemental passageways are of a semicircular shape in each of the mating halves of the manifold and become circular upon the precise mating and bonding together of the manifold halves.

The supplemental passageways, at their upper or input ends, are normally held sealed by rods or pistons 60 supported in cylindrical chambers 62 of the manifold beneath the bottles. The pistons have cylindrical ends 64 of a reduced diameter adapted to be held by coil springs 66 within mating apertures 68 in the manifold beneath the bottle support regions. When selectively slid downward against the action of an associated spring, each piston will force its end 64 downwardly from its aperture 68 and allow the flow of liquid from the container whose piston has been lowered. This permits the fluid additive to be drawn from its bottle under the action of a venturi force created by the flowing shower water. The drawn fluid, assisted by gravity, will then flow down its individual supplemental passageway and into the main passageway. It then enters the flow of shower water for mixing therewith.

When any piston 60 is lowered and the opening unsealed against the action of the coil springs, a complete passageway is thereby established between the valve 108 of the additive fluid of the bottle and the flow of shower water. The farther the rod is withdrawn from its seating adjacent the bottle, the greater will be the size of opening and the greater the rate of dispensing of the additive liquid. A coil spring 66 surrounds the piston between a piston collar 72 and a shoulder formed in the chamber 62 of the manifold 12. The coil spring effects the upward motion of the piston in sealing engagement with the aperture adjacent to the bottle. When the rod moves upwardly under the action of the spring, the essentially hemispherical shape of the upper end of the rod assists in locating the rod into its aperture to seal the valve 108 from the venturi forces and thus precludes the fluid from further flow.

Located at the upper end of each piston is an enlarged collar 72 with a circumferential recess for supporting an O-ring 74. This arrangement functions to preclude the leakage of fluid through the chamber 62 and the wasting of fluids.

Figure 6:
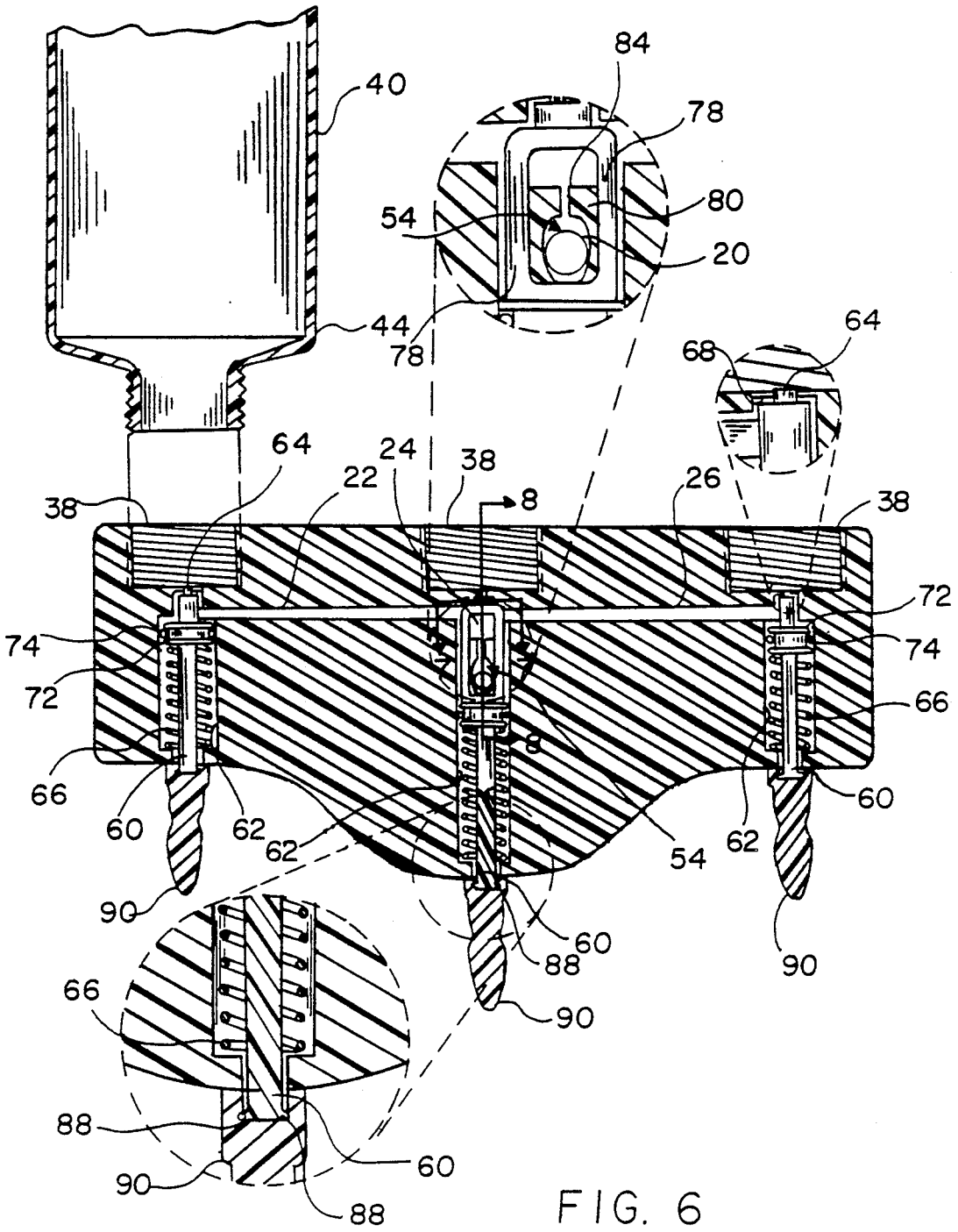
FIG. 6 is a sectional view taken along lines 6—6 of FIG. 5.
Figure 7:
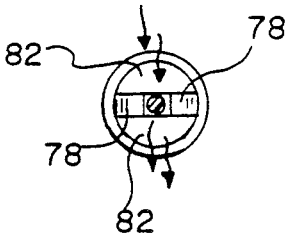
FIGS. 7 and 8 are sectional views taken along lines 7—7 and 8—8 of FIG. 6.
Figure 8:
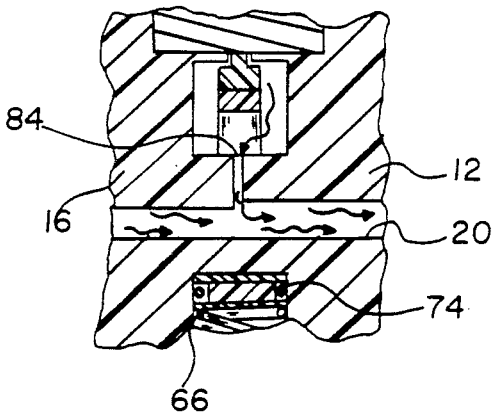

The piston for the central bottle is different from the pistons of the other bottles. As clearly seen in the upper central blow-out above FIG. 6, the central piston has an upper section with a cylinder of reduced diameter for sealing the aperture adjacent the bottle. Its lower section is provided with O-rings and a spring for urging the piston upwardly to seal the aperture between the upper and lower extents of this piston. These upper and lower sections are the same as the other pistons. The central section, however, is enlarged with spaced parallel legs 78 forming an opening and with a flat cross-section. Note FIG. 7. The opening is of such size as to receive a restriction component 80. The restriction component is formed integrally with one of the housing halves. Its opposite end is cylindrically shaped to conform with the vertical cylindrical recess of the other housing half. The opposed vertical edges of the restricting component are flat and parallel for receiving thereagainst the vertical, flat, parallel interior edges of the legs. The flatness of the legs allows them to be spaced from the wall of the central cylindrical chamber 62 and forms semicircular passages 82. The flow of fluids from all three bottles is through passages 82. Thereafter the fluids then flow through a vertically extending aperture 84 extending from the upper surface of the restriction component into the flow of shower water.

The vertical aperture 84 which extends through the restricting component 80 is of a reduced diameter when compared with the supplemental passageways and the main water passageway. In this manner, the venturi effect of the shower water is increased to open valve 108 and draw in the supplemental fluids from the bottles. In practice, the withdrawal of the pistons from their openings does not automatically allow the flow of supplemental fluids from the bottle. It merely allows venturi forces to urge open the valves 108 of the bottles to effect feeding of the fluids by the venturi force generated through the system.

The lower end of each piston is provided with a horizontal ears 88 extending therefrom. The ears receive recesses in the upper end of a handle 90. This allows the handle to be pulled downwardly to unseat the upper end of the rod. This allows the venturi forces to reach the valve 108 and thereby initiate the flow of fluid into the water stream for as long as the shower water is flowing and the handle is held lowered. Upon release of the handle, the resilience of the spring 66 will urge the piston upwardly with its upper end in seating engagement with the aperture 68 of the manifold 12 beneath the bottle. The piston being moved upwardly will seal the liquid passageway between the flow of water and the valve to preclude the venturi forces from holding open the valve. The flow of fluid is thereby stopped.

Figure 5:
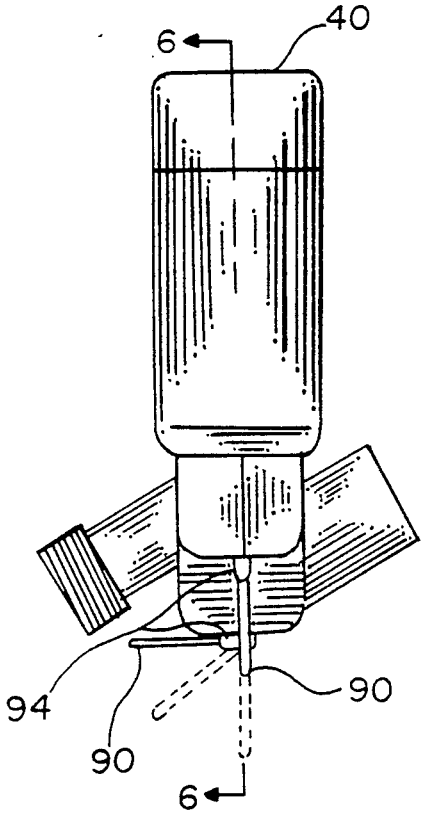

The upper end of the handle is formed with vertically extending flat portions 94 so that the handle, when lowered, may be pivoted about its ears 88 to a horizontal position. Note FIG. 5. When released in the horizontal position, a side of the handle will act as a cam and contact the lower face of the manifold to hold the piston in its lowermost unseated position. This effects a continuous flow of fluid from the bottle without intervention by the user. Rotation and return of the handle to the vertical position will allow its point to resile into seating orientation to stop the flow of the fluids.

Located in association with the end-most bottles are holes 98 for allowing a flow of air into the additive fluid at areas where the additive liquid is fed along the supplemental passageways. The use of the holes through the manifold in these locations is such that ambient air will be pulled by is own venturi action into the flow of fluid as it is being dispensed. The addition of the air to the additive fluid immediately prior to its mixture with the shower water will increase the emulsifying of the fluid for its more efficient and desirable use with the flowing shower water. The addition of air into the flowing additive fluid will also effect additional turbulence between the air and fluid thus converting the fluid into the more emulsified product. Further agitation occurs during mixing of the fluid with the shower water, increasing its cleansing action and magnifying its aromatic appeal.

The ball check valve 108, as referred to hereinabove, is simply a stopper 102 press fit into the opening of each bottle of supplemental fluid. Each stopper is positionable inside of the neck of the bottle for a friction fit to retain proper positioning. The central extent is a cavity 104 with an upper aperture 106 in communication with the contents of the bottle. A ball 108 functions to open and close the aperture. The ball is urged by a spring 110 into sealing contact with the aperture 106. This precludes the flow of fluid unless and until the ball is retracted against the action of the spring by the venturi forces created by the flowing shower water.

The lower end of the spring is held in position by a washer 112 with an aperture 114 press fit into a recess at the lower end of the stopper 102. In this manner, the frictional relationship between the washer and the stopper and between the stopper and the bottle effects the proper positioning of spring and ball. This effects the appropriate sealing of the fluids in the bottles until the venturi effect of the shower water creates a vacuum in the central cavity of the stopper through the aperture or the washer. When this occurs, the ball is sucked downwardly against the action of the spring to allow the venturi forces to draw the supplemental fluids from the bottle along the passageways into the flow of shower water. The action of gravity assists in the flow of the supplemental fluids.

The ball valve is of such design as to open under the venturi forces normally created by the flow of shower water. The ball valve design, however, is such that it will remain closed under the venturi forces tending to create a backflow of fluids during a malfunction of a community water system.

In carrying out the method of the present invention, a flow of shower water is first created through the main passageway 20 of the manifold 12. The user then dispenses one or more of selected additive fluids from locations above the flow of shower water whereby it will flow by the action of venturi forces created by the flowing shower water, assisted by gravity, through the supplemental passageways 22, 24 and 26 and enter the flow of shower water. The flow of supplemental fluid is effected by lowering the piston 60 so that the venturi forces created by the flowing water may function to open valve 56. Air holes 98 allow emulsifying air to enter the flow of fluids from the bottles by venturi forces created by the flowing fluid. Note is taken that the flow of additive fluid from any one bottle is accompanied by an emulsifying air flow from two holes for entering the stream at two points for maximum emulsification. Additional turbulence and emulsification occurs upon the mixing of additive fluid and flowing shower water.

In operation and use if a user moves a handle with no water running, there will be no venturi forces to open a piston or valve. No fluid will be dispensed. If a water flow is occurring with a piston closed, no fluid flow will occur since the venturi forces created will be insufficient to open a piston. The venturi forces will remain remote from the valves to retain them closed. If, however, the venturi forces are effected through the flow of water concurrently with an open piston, the venturi forces will effect a valve opening vacuum along a line defined by the passageways between the flowing water and the valve, passed its associated piston which is open. The venturi force is sufficient to open one or more valves simultaneously but insufficient to open any piston. Stopping the flow of fluid from a bottle is effected by closing a piston to close the line between the valve and flowing water and thereby remove the vacuum adjacent to the valve so that its spring may effect valve closure. Alternately, turning off the flow of water will stop the venturi forces and vacuum adjacent to the valve to allow its closing by its spring.

The present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A system for selectively dispensing one of a plurality of liquids into a stream of water flowing through a shower head, the system comprising:

a manifold formed with passageways and having a nipple for coupling with a shower head, a socket for receiving the nipple of a water supply pipe and a main water passageway between the housing nipple and the socket;

a plurality of downwardly facing containers for liquid to be fed therefrom through the passageways and out of the shower head, each of the containers being a refillable bottle with separable neck and base portions and with an air hole in each base portion;

a plurality of upwardly facing container support means in the housing for removably receiving and supporting the plurality of containers;

a spring biased ball valve means located in each container;

a liquid passageway connecting each ball valve means and the main water passageway whereby liquid from any of the containers may be selectively dispensed to the main water passageway by gravity and the venturi forces induced by the shower water flowing through the main water passageway;

a single operator controlled means for each of the liquid passageways downstream from the ball valve and spring biased toward a first position to close the liquid passageway and prevent the opening of the valve means and the dispensing of liquid from its associated container and movable against the spring to a second position to open the liquid passageway and open the valve means to allow the dispensing of liquid from its associated container; and a restricted orifice coupling the main water passageway and the liquid passageways to increase the venturi forces.

2. The system as set forth in claim 1 wherein the manifold is formed of plural components bonded into a one-piece device.

3. The system as set forth in claim 1 wherein each operator controlled means is a piston and further including resilient means associated with each of the pistons biasing its piston to the first position.

4. The system as set forth in claim 3 wherein a seal surrounds the end of each piston spaced from the liquid passageway whereby liquid is prevented from leaking therepast.

5. The system as set forth in claim 3 wherein each of the operator controlled means includes a handle having a cam whereby movement of the handle downwardly and pivotally causes the cam to contact an adjacent portion of the manifold to effect a continuous flow of fluid.

6. The system as set forth in claim 1 wherein each valve means includes a stopper positioned in its associated container with the ball of the spring biased ball valve means biased against an aperture in said stopper.

7. The system as set forth in claim 1 and further including a plurality of air holes in a manifold, one for each container for simultaneously introducing a flow of emulsifying air into the flow of liquid through each liquid passageway.

* * * * *